US007446252B2

(12) United States Patent
Tagawa et al.

(10) Patent No.: US 7,446,252 B2
(45) Date of Patent: Nov. 4, 2008

(54) MUSIC INFORMATION CALCULATION APPARATUS AND MUSIC REPRODUCTION APPARATUS

(75) Inventors: Junichi Tagawa, Kyoto (JP); Hiroaki Yamane, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 84 days.

(21) Appl. No.: 11/587,769

(22) PCT Filed: Jun. 24, 2005

(86) PCT No.: PCT/JP2005/011622

§ 371 (c)(1),
(2), (4) Date: Oct. 27, 2006

(87) PCT Pub. No.: WO2006/003848

PCT Pub. Date: Jan. 12, 2006

(65) Prior Publication Data

US 2007/0256548 A1 Nov. 8, 2007

(30) Foreign Application Priority Data

Jun. 30, 2004 (JP) ..... 2004-193645

(51) Int. Cl.
*G10H 1/46* (2006.01)
*G10H 1/36* (2006.01)

(52) U.S. Cl. ..... 84/633; 84/649; 84/650; 84/653; 84/654; 84/658; 84/663; 84/665; 84/666

(58) Field of Classification Search ..... 84/600–604, 84/606–611, 613–620, 622–628, 633–635, 84/647–651, 653–663, 665–667, 673–675, 84/677, 678, 680–682, 686, 692–696, 699–704, 84/744

See application file for complete search history.

(56) References Cited

U.S. PATENT DOCUMENTS

| | | | | |
|---|---|---|---|---|
| 5,048,390 | A * | 9/1991 | Adachi et al. | 84/464 R |
| 5,286,908 | A * | 2/1994 | Jungleib | 84/603 |
| 6,310,279 | B1 * | 10/2001 | Suzuki et al. | 84/600 |
| 6,831,657 | B2 * | 12/2004 | Tsutsumi et al. | 345/589 |
| 2002/0154787 | A1 * | 10/2002 | Rice et al. | 381/124 |

FOREIGN PATENT DOCUMENTS

| | | | |
|---|---|---|---|
| JP | 04134496 | A * | 5/1992 |
| JP | 04-174696 | | 6/1992 |
| JP | 06-118982 | | 4/1994 |
| JP | 09-214894 | | 8/1997 |
| JP | 11-073193 | | 3/1999 |
| JP | 2000-148107 | | 5/2000 |
| JP | 2002-023716 | | 1/2002 |
| JP | 2002023716 | A * | 1/2002 |
| JP | 2004-240077 | | 8/2004 |
| SU | 1245333 | A * | 7/1986 |

* cited by examiner

*Primary Examiner*—Jeffrey Donels
*Assistant Examiner*—Christopher Uhlir
(74) *Attorney, Agent, or Firm*—Wenderoth, Lind & Ponack, L.L.P.

(57) ABSTRACT

A music information calculation apparatus recognizing a structure of a piece of music based on an acoustic signal. The apparatus includes: an acoustic signal input for inputting the acoustic signal of the piece of music; an acoustic parameter calculator for calculating, using the acoustic signal, at least a first acoustic parameter indicating a volume of the piece of music; an inflection degree calculator for calculating, using at least the first acoustic parameter, an inflection degree indicating an inflection of the piece of music; a story node calculator for calculating, using at least the first acoustic parameter, a story node representing a time at which a formation of the piece of music changes; and a story information calculator for calculating, as story information indicating at least a correspondence between the story node having been calculated and the inflection degree obtained at the time represented by the story node.

8 Claims, 9 Drawing Sheets

FIG.5

| NODE NAME | NODE TYPE | TIME | STORY VALUE |
|---|---|---|---|
| NODE 201 | MUSIC START POINT | 0'02"35 | 0.00 |
| NODE 202 | TUTTI START POINT | 0'13"02 | 0.75 |
| NODE 203 | TUTTI END POINT | 0'19"73 | 0.75 |
| NODE 204 | CHAPTER START POINT | 0'23"43 | 0.37 |
| NODE 205 | BREAK START POINT | 1'05"13 | 0.35 |
| NODE 206 | BREAK END POINT | 1'09"05 | 0.12 |
| NODE 207 | CLIMAX PART START POINT | 1'23"45 | 1.00 |
| NODE 208 | CHAPTER END POINT | 2'08"33 | 0.91 |
| NODE 209 | CHAPTER START POINT | 2'10"01 | 0.67 |
| NODE 210 | CHAPTER END POINT | 2'13"15 | 0.66 |
| NODE 211 | TUTTI START POINT | 2'37"42 | 0.87 |
| NODE 212 | TUTTI END POINT | 2'42"55 | 0.86 |
| NODE 213 | MUSIC END POINT | 3'00"00 | 0.00 |

FIG.7

| NODE TYPE | VIDEO EFFECT |
| --- | --- |
| MUSIC START POINT | FADE IN (①) |
| TUTTI START POINT | ONE SECOND FLASH (②) |
| CHAPTER START POINT | IMAGE GROUP CHANGE (③) |
| BREAK START POINT | 0.5 SECOND BLACK SCREEN (④) |
| CLIMAX PART START POINT | ONE SECOND IMAGE ROTATION (⑤) |
| MUSIC END POINT | FADE OUT (⑥) |

MUSIC INFORMATION CALCULATION APPARATUS AND MUSIC REPRODUCTION APPARATUS

BACKGROUND OF THE INVENTION

1. Field of the Invention

The present invention relates to an apparatus for calculating music information, and more particularly relates to an apparatus for calculating, based on an acoustic signal of a piece of music, information used for controlling a device which renders lighting, a video and the like according to the piece of music so as to provide the information, and a music reproduction apparatus capable of controlling the lightning and the rendering.

2. Description of the Related Art

Conventionally, as an apparatus for rendering a video accompanying the music being reproduced, an apparatus has been suggested which calculates a musical feature based on an acoustic signal so as to render a video (Patent Document 1). The apparatus calculates low frequency components and patterns based on music data so as to acquire rhythm information, and displays an image in synchronization with the rhythm information having been acquired. The apparatus disclosed in Patent Document 1 calculates the rhythm information as the musical feature of apiece of music, and therefore an effect of displaying and rendering the video in synchronization with the rhythm can be changed.

Patent Document 1: Japanese Laid-Open Patent Publication No. 2000-148107

BRIEF DESCRIPTION OF THE INVENTION

Problems to be Solved by the Invention

In general, dramatic parts of a tune and music vary as time passes, that is, the piece of music has a music structure such as a musical time structure and a melody. However, an image processing apparatus disclosed in Patent Document 1 performs displaying and rendering based on only a rhythm among the musical features of a piece of music. Therefore, there is a problem that it is difficult to perform rendering based on the music structure with enhanced visual effect so as to, for example, "quickly change an image when the piece of music becomes dramatic", or "change an image type when a climax part starts".

Further, in order to perform the rendering based on the aforementioned musical formation with the enhanced visual effect, an operator listening to the music is required to manually acquire the music structure. Therefore, it has not been easy to render a video based on the musical features of the piece of music with the enhanced visual effect.

Therefore, an object of the present invention is to provide a music information calculation apparatus capable of recognizing a music structure based on an acoustic signal of a piece of music.

Another object of the present invention is to provide a music reproduction apparatus for reproducing music and rendering a video based on the music structure having been acquired with the enhanced visual effect.

Solution to the Problems

The object of the present invention is attained by the following music information calculation apparatus. Provided are: an acoustic signal input means for inputting an acoustic signal of a piece of music; an acoustic parameter calculation means for calculating, using the acoustic signal, at least a first acoustic parameter indicating a volume of the piece of music; an inflection degree calculation means for calculating, using at least the first acoustic parameter, an inflection degree indicating an inflection of the piece of music; a story node calculation means for calculating, using at least the first acoustic parameter, a story node representing a time at which a formation of the piece of music changes; and a story information calculation means for calculating, as story information indicating the formation of the piece of music, information indicating at least a correspondence between the story node having been calculated and the inflection degree obtained at the time represented by the story node.

According to the features, the time at which the formation of the piece of music musically changes and the dramatic level of the piece of music can be calculated, as music information, based on the acoustic signal. Therefore it is possible to easily recognize a music structure with no need to listen to the piece of music.

Preferably, the story node calculation means calculates the story node in accordance with a value of the first acoustic parameter.

According to the features, the time at which the formation of the piece of music musically changes can be calculated based on the acoustic signal, and therefore it is possible to easily recognize the music structure with no need to listen to the piece of music.

Preferably, the story information calculation means calculates a type of the story node using the inflection degree having been calculated, and calculates, as the story information indicating the formation of the piece of music, information indicating a correspondence among the story node, the inflection degree obtained at the time represented by the story node, and the type of the story node.

According to the features, a musical formation of each story node can be recognized, and therefore it is possible to more specifically recognize the music structure with no need to listen to the piece of music.

Preferably, the acoustic parameter calculation means further calculates, using the acoustic signal, a second acoustic parameter indicating a tone of the piece of music, and the inflection degree calculation means calculates the inflection degree using the first acoustic parameter and the second acoustic parameter.

According to the features, a magnitude of a feature relating to the tone or the volume can be calculated based on the acoustic signal. Therefore it is possible to acquire the dramatic level of the piece of music and the time at which the formation of the piece of music musically changes.

Preferably, the first acoustic parameter indicates a short time power average value of the acoustic signal, the second acoustic parameter indicates a zero cross value of the acoustic signal, and the inflection degree calculation means calculates, as the inflection degree, a product of the short time power average value and the zero cross value of the acoustic signal.

According to the features, a change of the dramatic level of the piece of music can be detected based on the acoustic signal, and therefore it is possible to recognize the music structure with no need to listen to the piece of music.

Preferably, the second acoustic parameter indicates one selected from the group consisting of the zero cross value of the acoustic signal, a mel frequency cepstrum coefficient, and a spectrum centroid.

According to the features, it is possible to calculate a magnitude of a feature relating to the tone based on the acoustic signal and to recognize the music structure with no need to listen to the piece of music. Further, the magnitude of the feature relating to the tone can be calculated with a reduced amount of calculation by using the zero cross value, and the feature relating to the tone and an amplitude envelope feature can be obtained by using the mel frequency cepstrum coefficient and the spectrum centroid.

The first acoustic parameter indicates one selected from the group consisting of the short time power average value of the acoustic signal, a mel frequency cepstrum coefficient, and a spectrum centroid.

According to the features, a magnitude of feature relating to the volume can be calculated based on the acoustic signal of the piece of music. Therefore it is possible to recognize the music structure with no need to listen to the piece of music. Further, it is possible to calculate the magnitude of a feature relating to the volume with reduced amount of calculation by using the short time power average value.

The object of the present invention is attained by the following music reproduction apparatus. The music reproduction apparatus, which reproduces a video synchronized to a piece of music, comprises: an acoustic signal storage means for storing an acoustic signal of the piece of music; an image data storage means for storing image data; an acoustic parameter calculation means for calculating, using the acoustic signal, at least a first acoustic parameter indicating a volume of the piece of music; an inflection degree calculation means for calculating using at least the first acoustic parameter, an inflection degree indicating an inflection of the piece of music; a story node calculation means for calculating, using at least the first acoustic parameter, a story node representing a time at which a formation of the piece of music changes; a story information calculation means for calculating, as story information indicating the formation of the piece of music, information indicating at least a correspondence between the story node having been calculated and the inflection degree obtained at the time represented by the story node; a music reproduction means for reproducing the acoustic signal of the piece of music; a video generation means for generating the video using the image data; and a display means for displaying the video generated by the video generation means in synchronization with the piece of music being reproduced by the music reproduction means, in which the video generation means generates the video such that a content of the video is subjected to a predetermined change at a time defined by the story node contained in the story information, and determines a type of the predetermined change using the inflection degree obtained at the time represented by the story node.

According to the features, it is possible to subject the content of the video to the change based on the music structure, and therefore it is possible to reproduce the piece of music and render the video with enhanced visual effect.

Preferably, a rendering table storage means for storing a rendering table representing a correspondence between a type of the story node of the piece of music and the type of the change to which the video is to be subjected at the time defined by the story node of the type, is further provided. Further, the story information calculation means determines the type of the story node using the inflection degree obtained at the time represented by the story node, and calculates, as the story information, information indicating a correspondence among the story node, the inflection degree obtained at the time represented by the story node, and the type of the story node. In addition, the video generation means generates the video such that the content of the video is subjected to the predetermined change at the time represented by the story node contained in the story information, and determines the type of the predetermined change using the type of the story node.

According to the features, the musical formation of each story node can be recognized, and therefore it is possible to more specifically recognize the music structure with no need to listen to the piece of music. Thus, a rendering based on the music structure can be performed with enhanced visual effect and a wide range of variation.

Preferably, the rendering table storage means stores the rendering table containing a correspondence between a fading-out process and the story node representing a music end, and the video generation means starts to subject the video to the fading-out process at a point which precedes, by a predetermined time, an end point of the story node having the type of the story node determined as the music end.

Preferably, a process of the video generation means subjecting the content of the video to the change is one process selected from the group consisting of a fading-in process, a fading-out process, an image change process, and an image rotation process.

According to the features, the video can be automatically rendered in accordance with the type of the story node with no need to listen to the piece of music. Therefore it is possible to provide a user-friendly music reproduction apparatus. Further, according to the features, an editing process, to be performed by a specialist in video editing, can be easily performed with no need to listen to the piece of music.

The object of the present invention is attained by the following music information calculation method. Provided are an acoustic signal input step of inputting an acoustic signal of a piece of music; an acoustic parameter calculation step of calculating, using the acoustic signal, at least a first acoustic parameter indicating a volume of the piece of music; an inflection degree calculation step of calculating, using at least the first acoustic parameter, an inflection degree indicating an inflection of the piece of music; a story node calculation step of calculating, using at least the first acoustic parameter, a story node representing a time at which a formation of the piece of music changes; and a story information calculation step of calculating, as story information indicating the formation of the piece of music, information indicating at least a correspondence between the story node having been calculated and the inflection degree obtained at the time represented by the story node.

The object of the present invention is attained by the following music information calculation circuit. Provided are an acoustic signal input means for inputting an acoustic signal of a piece of music; an acoustic parameter calculation means for calculating, using the acoustic signal, at least a first acoustic parameter indicating a volume of the piece of music; an inflection degree calculation means for calculating, using at least the first acoustic parameter, an inflection degree indicating an inflection of the piece of music; a story node calculation means for calculating, using at least the first acoustic parameter, a story node representing a time at which a formation of the piece of music changes; and a story information calculation means for calculating, as story information indicating the formation of the piece of music, information indicating at least a correspondence between the story node having been calculated and the inflection degree obtained at the time represented by the story node.

The object of the present invention is attained by a program being executed by a computer. The program is for causing a computer of a music information calculation apparatus for calculating story information indicating a formation of a piece of music to execute a method including: an acoustic signal input step of inputting an acoustic signal of apiece of music; an acoustic parameter calculation step of calculating, using the acoustic signal, at least a first acoustic parameter indicating a volume of the piece of music; an inflection degree calculation step of calculating, using at least the first acoustic parameter, an inflection degree indicating an inflection of the piece of music; a story node calculation step of calculating, using at least the first acoustic parameter, a story node representing a time at which a formation of the piece of music changes; and a story information calculation step of calculating, as the story information indicating the formation of the piece of music, information indicating at least a correspondence between the story node having been calculated and the inflection degree obtained at the time represented by the story node.

The object of the present invention is attained by a program recorded onto a computer-readable recording medium. The recorded program is for causing a computer, of a music information calculation apparatus for calculating story information indicating a formation of a piece of music, to execute a method including: an acoustic signal input step of inputting an acoustic signal of a piece of music; an acoustic parameter calculation step of calculating, using the acoustic signal, at least a first acoustic parameter indicating a volume of the piece of music; an inflection degree calculation step of calculating, using at least the first acoustic parameter, an inflection degree indicating an inflection of the piece of music; a story node calculation step of calculating, using at least the first acoustic parameter, a story node representing a time at which a formation of the piece of music changes; and a story information calculation step of calculating, as the story information indicating the formation of the piece of music, information indicating at least a correspondence between the story node having been calculated and the inflection degree obtained at the time represented by the story node.

As described above, the music information calculation apparatus of the present invention is applicable as a music information calculation apparatus capable of recognizing a music structure based on an acoustic signal of a piece of music.

Further, as described above, the music reproduction apparatus of the present invention is applicable as a music reproduction apparatus for reproducing music and rendering a video with enhanced visual effect based on the music structure having been acquired.

BRIEF DESCRIPTION OF THE DRAWINGS

FIG. 5 is a diagram illustrating exemplary story node attributes according to the first embodiment.

FIG. 7 is a diagram illustrating an exemplary rendering table of rendering patterns in the music reproduction apparatus according to the second embodiment.

DETAILED DESCRIPTION OF THE INVENTION

Embodiment 1

Figure 1:
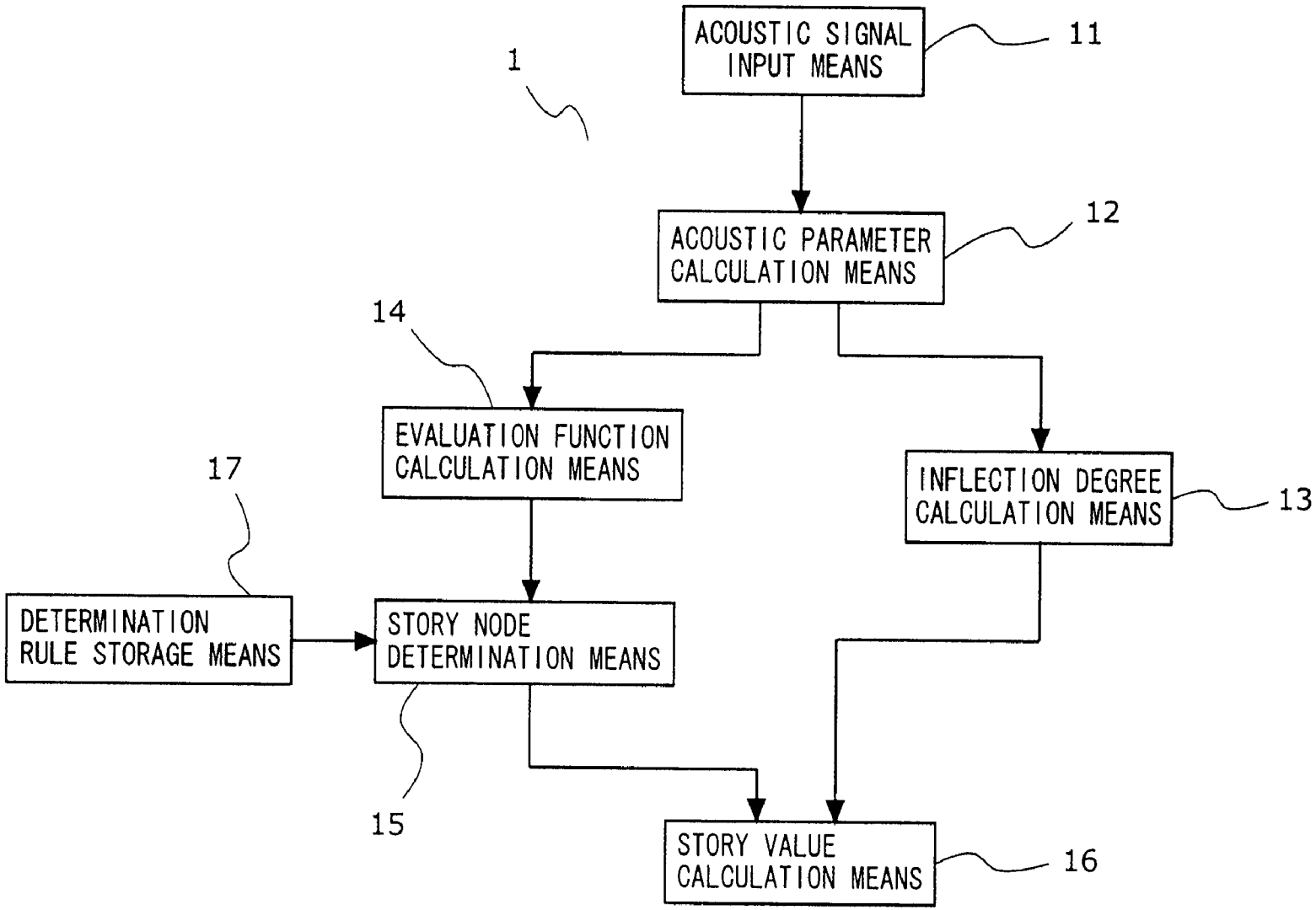
FIG. 1 is a block diagram illustrating a structure of a music information calculation apparatus according to a first embodiment.

FIG. 1 is a block diagram illustrating a structure of a music information calculation apparatus according to a first embodiment of the present invention. As shown in FIG. 1, the music information calculation apparatus 1 mainly comprises: an acoustic signal input means 11; an acoustic parameter calculation means 12; an inflection degree calculation means 13; an evaluation function calculation means 14; a story node determination means 15; a story value calculation means 16; and a determination rule storage means 17. The music information calculation apparatus is realized as, for example, being incorporated into a computer.

In FIG. 1, each of the acoustic parameter calculation means 12, the inflection degree calculation means 13, the evaluation function calculation means 14, the story node determination means 15, and the story value calculation means 16 is shown as a separate block. However, these means may not be necessarily separated from each other, and they may be provided on one chip as an integrated circuit such as an LSI or a dedicated signal processing circuit. Alternatively, circuits functioning as the respective blocks may be provided as chips, respectively. When the LSI includes a temporary memory, the determination rule storage means 17 may be included in the LSI. The LSI described here is also referred to as an IC, a system LSI, a super LSI, or an ultra LSI, depending on an integration level. Further, the integrated circuit may not be necessarily an LSI, and may be realized as a dedicated circuit or a general-purpose processor. It is possible to use an FPGA (Field Programmable Gate Array) which is programmable after a production of an LSI, or a reconfigurable processor which can reconfigure, after a production of an LSI, a connection between and setting of circuit cells inside the LSI. Further, when an advance in semiconductor technology or another technology derived from the advance leads to an appearance of a circuit-integration technology which can replace the LSI, it goes without saying that an integration of the functional blocks may be performed using the technology.

In general, a piece of music includes points at which tunes change, portions in which the piece of music becomes dramatic, points at which rhythms change, points at which phrases change, and the like, from beginning to end thereof. That is, the piece of music has a music structure such as a musical time structure and a melody. In the present embodiment, each of the musical time structure and the melody is referred to as a "music story". Hereinafter, a boundary at which the musical time structure or the melody changes is referred to as a "story node" or a "node". The story node is represented as time information (hereinafter, referred to as a "reproduction time") indicating an elapsed time from the beginning of the piece of music.

Figure 2:
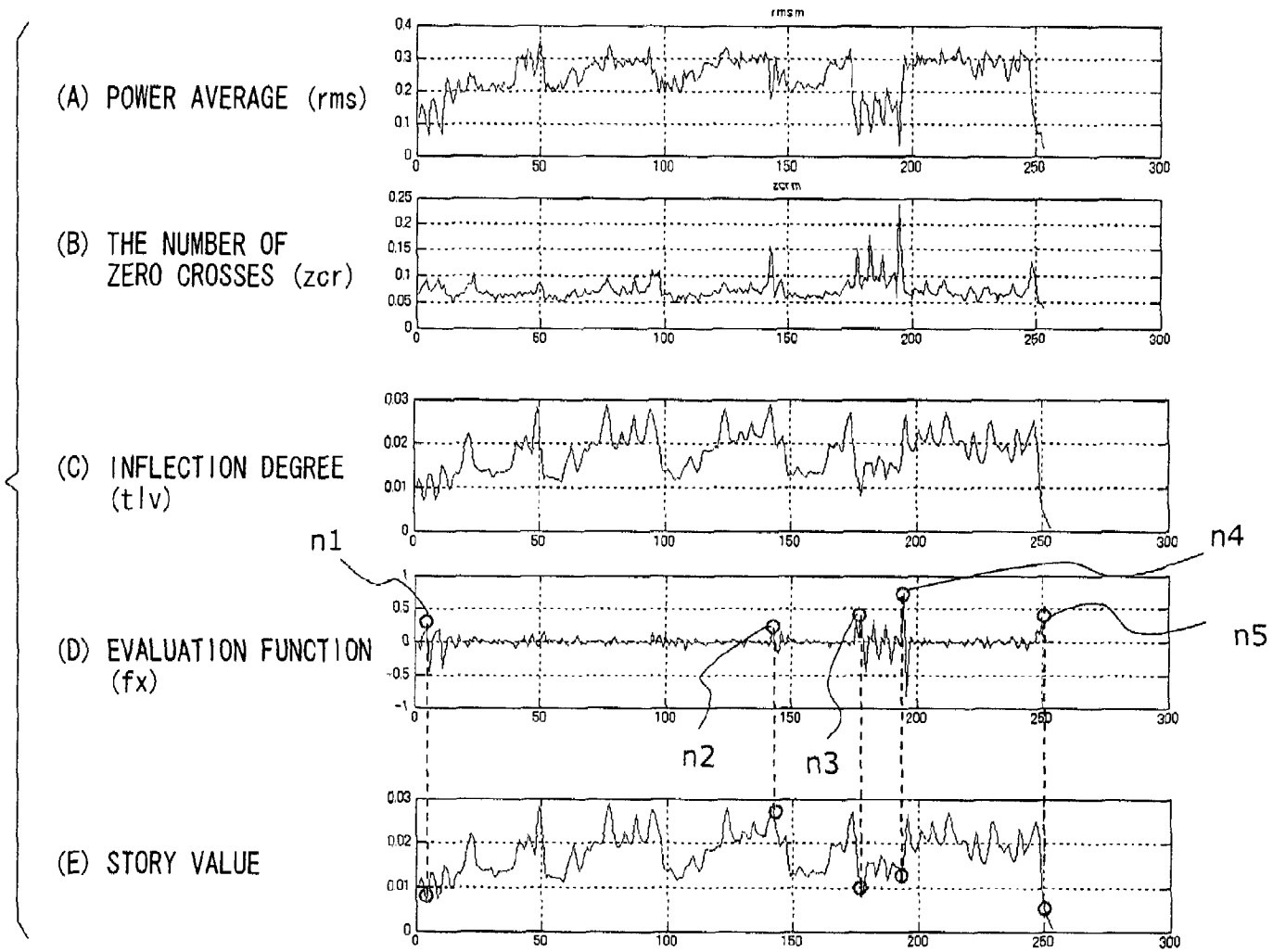
FIG. 2 is a diagram illustrating a temporal change of an output signal during a process performed by the music information calculation apparatus according to the first embodiment.

FIG. 2 shows a temporal change of a magnitude of feature of a piece of music calculated by each of the components shown in FIG. 1. FIGS. 2(A), 2(B), 2(C), 2(D) and 2(E) show temporal changes of a short time power average value, a zero cross value, an inflection degree, an evaluation function, and a story value, respectively, which are described below. In FIG. 2 an axis of ordinates represents an output value of each of the components, and an axis of abscissas represents an elapsed time from the beginning of the piece of music. "n1" to "n5" in each of FIGS. 2(D) and 2(E) represent reproduction times at which the story nodes each representing a musical boundary are determined.

The acoustic signal input means 11 inputs an acoustic signal of a piece of music to be processed. The acoustic signal represents, for example, PCM data of one entire piece of music stored in a recording medium such as a hard disk drive. The acoustic signal may be outputted to the acoustic parameter calculation means after the one entire piece of music is inputted or the acoustic signal may be outputted for each input in a case where a magnitude of a feature is calculated in real time each time the acoustic signal is inputted. The output for each input enables a real-time process.

The acoustic parameter calculation means 12 calculates one or a plurality of predetermined acoustic parameters for each input or for the one entire piece of music. The acoustic parameter represents a waveform of the acoustic signal or a magnitude of a feature obtained by analyzing the waveform, and is represented as a time function. In the present embodiment, as the acoustic parameter, the short time power average value rms (t) and the zero cross value zcr(t) are used. The short time power average value is obtained by subjecting, when the acoustic signal is divided into sections at intervals of a predetermined unit time, amplitudes of the acoustic signal to root mean square in each of the sections, and represents a magnitude of an average amplitude of the acoustic signal in each of the sections. The short time power average value is an index indicating a change of a volume of the piece of music. The zero cross value represents the number of times a sign of the acoustic signal changes in each of the sections. The zero cross value is an index indicating a tone of the piece of music. By using the short time power average value and the zero cross value, the acoustic parameter calculation means 12 can calculate the volume, the tone and the like of the piece of music with a relatively reduced amount of calculation process. FIG. 2(A) shows the temporal change of the short time power average value outputted by the acoustic parameter calculation means 12. FIG. 2(B) also shows the temporal change of the zero cross value. As shown in FIGS. 2(A) and 2(B), each of the short time power average value and the zero cross value varies as time passes in the piece of music.

The inflection degree calculation means 13 calculates an inflection degree based on one or a plurality of acoustic parameters. Here, the inflection degree represents a dramatic level of the piece of music, that is, an inflection degree of the piece of music, and is represented as a time function. In the present embodiment, the inflection degree is calculated based on the short time power average value and the zero cross value using the following equation:

$$tlv(t)=rms(t)\times zcr(t) \quad \text{(equation 1)}$$

According to equation 1, a portion in which "a volume (short time power average value) is high and a tone (zero cross value) is high" can be determined as a portion in which the piece of music becomes dramatic. Thus, a value obtained by multiplying the short time power average value by the zero cross value can be used to determine the dramatic level of the piece of music at each reproduction time and also determine the musical inflection throughout the one entire piece of music. FIG. 2(C) shows the temporal change of an output signal from the inflection degree calculation means 13. FIG. 2(C) shows that the greater numeric value the inflection degree has, the more dramatic the piece of music becomes in a musical sense.

The evaluation function calculation means 14 calculates an evaluation function based on one or a plurality of acoustic parameters. The evaluation function represents a function used for detecting for a story node representing the musical boundary, and is represented as a time function. The evaluation function fx1(t) of the present embodiment is defined by the following equation using the short time power average value among the acoustic parameters.

$$fx1(t)=-(rms(t)-rms(t-1)) \quad \text{(equation 2)}$$

It is generally considered that the volume substantially changes at the story node representing the musical boundary. Therefore, an amount of change of the short time power average value is calculated using the evaluation function, whereby it is possible to detect for the musical boundary, i.e., the story node. FIG. 2(D) shows the temporal change of an output signal from the evaluation function calculation means 14. In an example shown in FIG. 2(D), a value of the evaluation function substantially changes at a plurality of points in the one piece of music.

The determination rule storage means 17 stores a determination rule defined for each node type. Here, the node type represents a musical formation of the music structure, i.e., a musical attribute. Further, based on the determination rule, the below-described story node determination means 15 determines whether or not the evaluation function represents a specific story node. For example, the node type includes "a tutti start point and a tutti end point", "a break start point and a break end point", "a chapter start point and a chapter end point", and "a music start point and a music end point". Each of the node types has the following musical formation. For example, the "tutti" represents a dramatic phrase portion which is inserted into a piece of music for a short time so as to provide the piece of music with variety, and the "break" represents a quiet portion which is inserted into the piece of music for a short time so as to provide the piece of music with variety. The "chapter" represents a basic unit of the piece of music such as an introduction, an A melody, and a B melody. Further, the "music start and end" represent portions, including no silent portions before and after music data, at which the music substantially starts and ends, respectively.

Here, an exemplary determination rule for the node type representing the "break start point" will be described. The determination rule storage means 17 stores the determination rule defined for the "break start point" as follows.

(1) A reproduction time at which fx1(t) indicates a maximum value is set as a node candidate, and a value of fx1 represents a priority level.

(2) In a case where, when the node candidates are calculated in order of priority, a node candidate having a higher priority than a target node candidate to be calculated appears within five seconds before or after the target node candidate to be calculated, the target node candidate to be calculated is eliminated from the node candidates.

(3) The nodes are sequentially calculated in a manner described in (2), and when the number of nodes reaches a predetermined maximum number, the node determination process is ended.

Thus, the determination rule storage means 17 stores, for each node type, rules defined for determining whether or not the evaluation function represents the story node.

The story node determination means 15 determines whether or not the evaluation function having been calculated represents the story node representing the musical boundary. At this time, the determination process is performed by determining, based on the determination rules stored in the determination rule storage means 17, whether or not the evaluation function having been calculated represents a specific node type. When the evaluation function having been calculated represents the specific node type, the story node determination means 15 outputs the relevant time (story node) and node type to the story value calculation means 16. "n1" to "n5" shown in FIG. 2 represent points at which the story node determination means 15 determines the node types as the "breaks". Thus, the story node determination means 15 can detect the story node representing the musical boundary based on the evaluation function.

The story value calculation means 16 calculates a story value based on the inflection degree acquired by the inflection degree calculation means 13 and the story node acquired by the story node determination means 15. Here, the story value represents a numeric value indicating a time structure of a piece of music. In the present embodiment, as the story value, a value of the inflection degree of each story node is calculated. As shown in FIG. 2(E), the story value calculation means 16 calculates the inflection degree of each story node (n1 to n5) as the story value.

Figure 3:
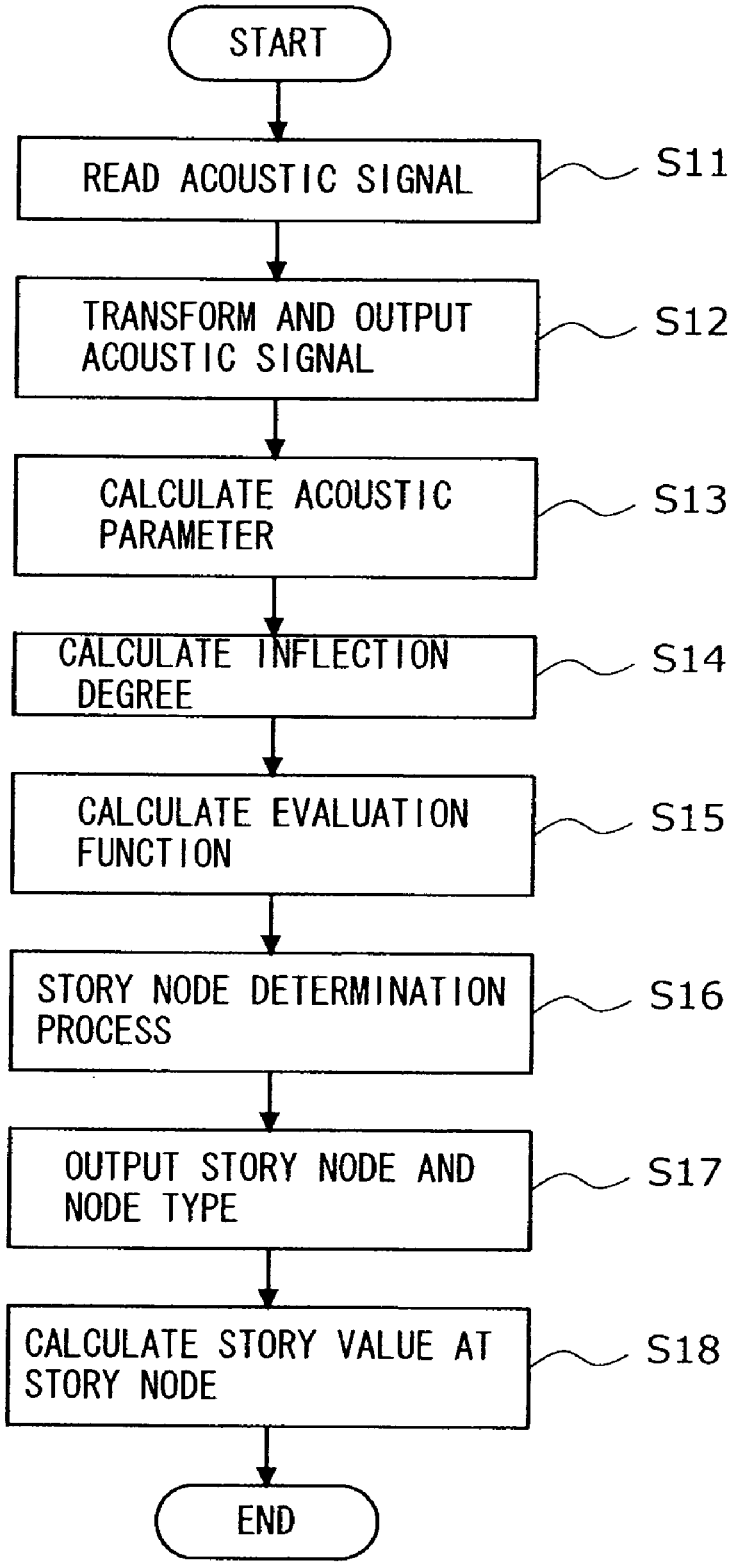
FIG. 3 is a flow chart illustrating a music information calculation process performed by the music information calculation apparatus according to the first embodiment.

Next, a process of calculating a music story according to the present embodiment will be described. FIG. 3 is a flow chart illustrating music information calculation process. The process shown in FIG. 3 is performed, for example, when the music information calculation apparatus is powered on.

Initially, in step S11, the acoustic signal input means 11 reads an acoustic signal stored in a recording medium. The acoustic signal input means 11 reads PCM data of one entire piece of music stored in a hard disk drive not shown. Subsequently, in step S12, the acoustic signal input means 11 transforms the acoustic signal having been read into a signal having a data format which can be processed by the acoustic parameter calculation means 12, and outputs the transformed signal to the acoustic parameter calculation means 12.

Next, in a process of step S13, the acoustic parameter indicating a magnitude of a feature of the acoustic signal is calculated. That is, the acoustic parameter calculation means 12 calculates the short time power average value and the zero cross value based on data of the acoustic signal having been outputted by the acoustic signal input means 11. The acoustic parameter calculation means 12 outputs the short time power average value having been calculated to the inflection degree calculation means 13 and the evaluation function calculation means 14. The zero cross value having been calculated is outputted to the inflection degree calculation means 13.

In a process of step S14, the inflection degree indicating an inflection of the piece of music is calculated. The inflection degree calculation means 13 calculates the inflection degree based on the short time power average value and the zero cross value having been acquired in step S13 using equation 1. The inflection degree having been calculated is outputted to the story value calculation means 16.

Next, in a process of step S15, the evaluation function is calculated. As described above, the evaluation function is a function used for detecting for the story node. The evaluation function calculation means 14 calculates the evaluation function using equation 2 based on the short time power average value having been acquired in step S13. The evaluation function having been calculated is outputted to the story node determination means 15.

In a process of step S16, the story node determination means 15 determines whether or not the evaluation function having been calculated in step S15 represents a specific node type. At this time, the determination process by the story node determination means 15 is performed based on the determination rules stored in the determination rule storage means 17. When it is determined that the evaluation function represents the specific node type, the story node determination means 15 outputs, in the following step S17, the relevant reproduction time (story node) and the node type to the story value calculation means 16.

Next, in a process of step S18, the story value calculation means 16 calculates story information. The story information represents information indicating a story (structure) of a piece of music, and specifically represents information indicating the inflection degree acquired at a time represented by each story node. That is, the story value calculation means 16 calculates, as the story values, the inflection degrees acquired at times represented by the story nodes having been acquired in step S17 among the inflection degrees having been calculated in step S14. Further, in the present embodiment, the story value calculation means 16 outputs the story values having been calculated, the story nodes corresponding to the story values, and the node types of the story nodes as the story information. This is the end of a series of processes relating to the music information calculation. In the process shown in FIG. 3, although the evaluation function is calculated after the inflection degrees are calculated, the present invention is not restricted thereto. Even when the process of step S14 and the processes of steps S15 to S17 are performed in reverse order, the story information of the piece of music can be acquired in the same manner as performed in the process shown in FIG. 3.

Figure 4:
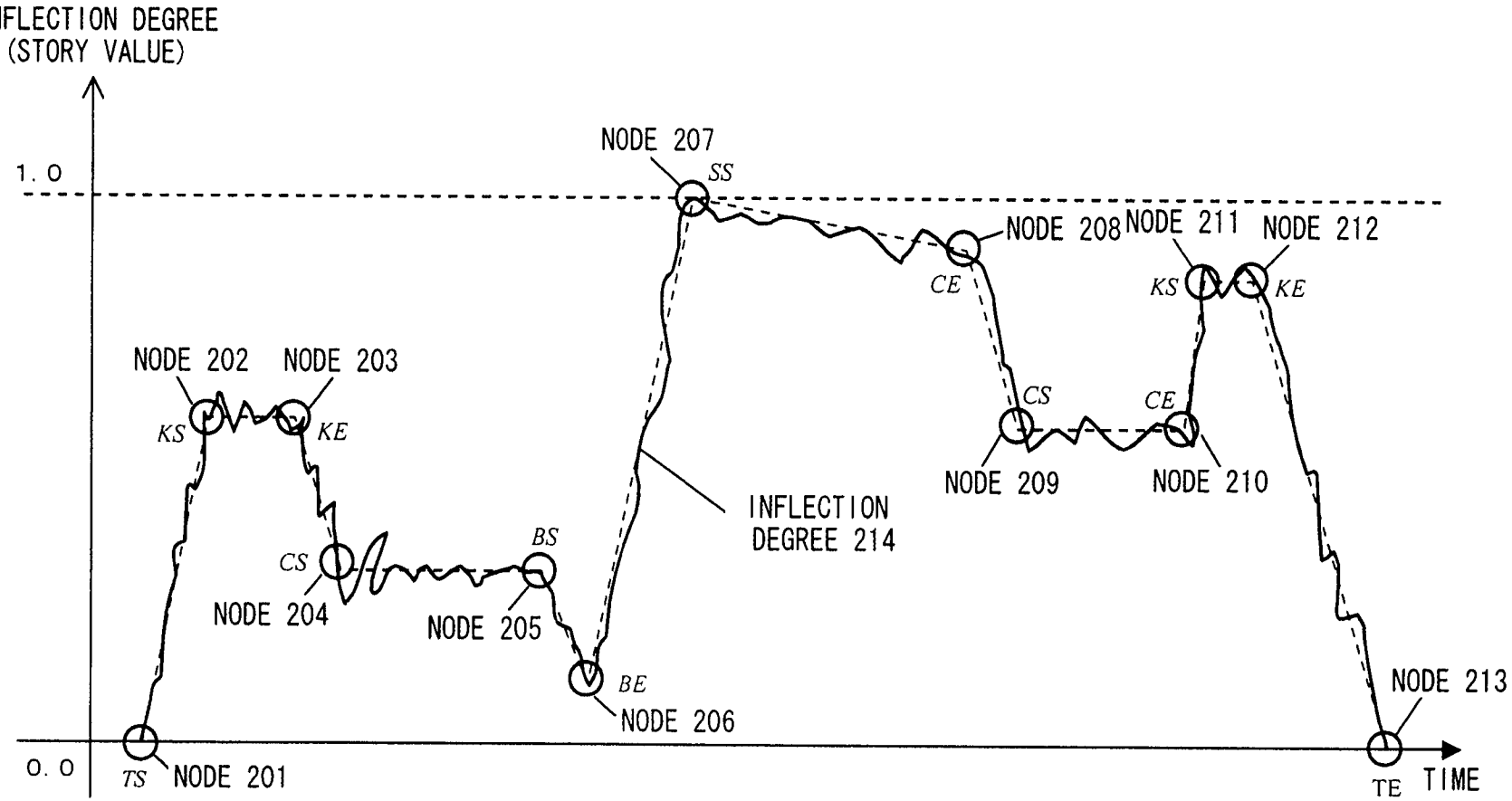
FIG. 4 is a diagram illustrating a temporal change of story information calculated by the music information calculation apparatus according to the first embodiment.

FIG. 4 shows a relationship between the story nodes and a change of the inflection degree in a piece of music A. Further, FIG. 5 shows story node attributes of the piece of music A. In FIG. 4, an axis of ordinates represents values of the inflection degrees, an axis of abscissas represents a time, and the value of the inflection degree of each story node represents the story value as described above. In FIG. 4 a solid curved line 214 represents a temporal change of the inflection degree of the piece of music A. Nodes 201 to 213 plotted on the curved line 214 each represents the story node which is determined, by the story node determination means, as corresponding to the specific node type. Further, the dotted lines in FIG. 4, which form a straight line connecting from the node 201 to the node 213, represent a temporal change of the story value. The music information calculation apparatus 1 calculates the story information by processing the acoustic signal of the piece of music A as shown in the aforementioned flow chart, thereby enabling the acquisition of the story node attributes, shown in FIG. 5, of the piece of music A. Thus, the music information calculation apparatus 1 acquires, from the piece of music A, the musical boundaries (story nodes) and the inflection degrees (story values) at the boundaries. Accordingly, the music information calculation apparatus can recognize the music structure by calculating the story information based on the acoustic signal.

As described above, the music information calculation apparatus, according to the present embodiment, can detect the musical boundaries in one entire piece of music based on the magnitude of feature of the acoustic signal. Further, the musical attributes can be detected at each time based on the magnitude of feature of the acoustic signal. Accordingly, a user can easily recognize the music structure without listening to the piece of music.

Embodiment 2

Figure 6:
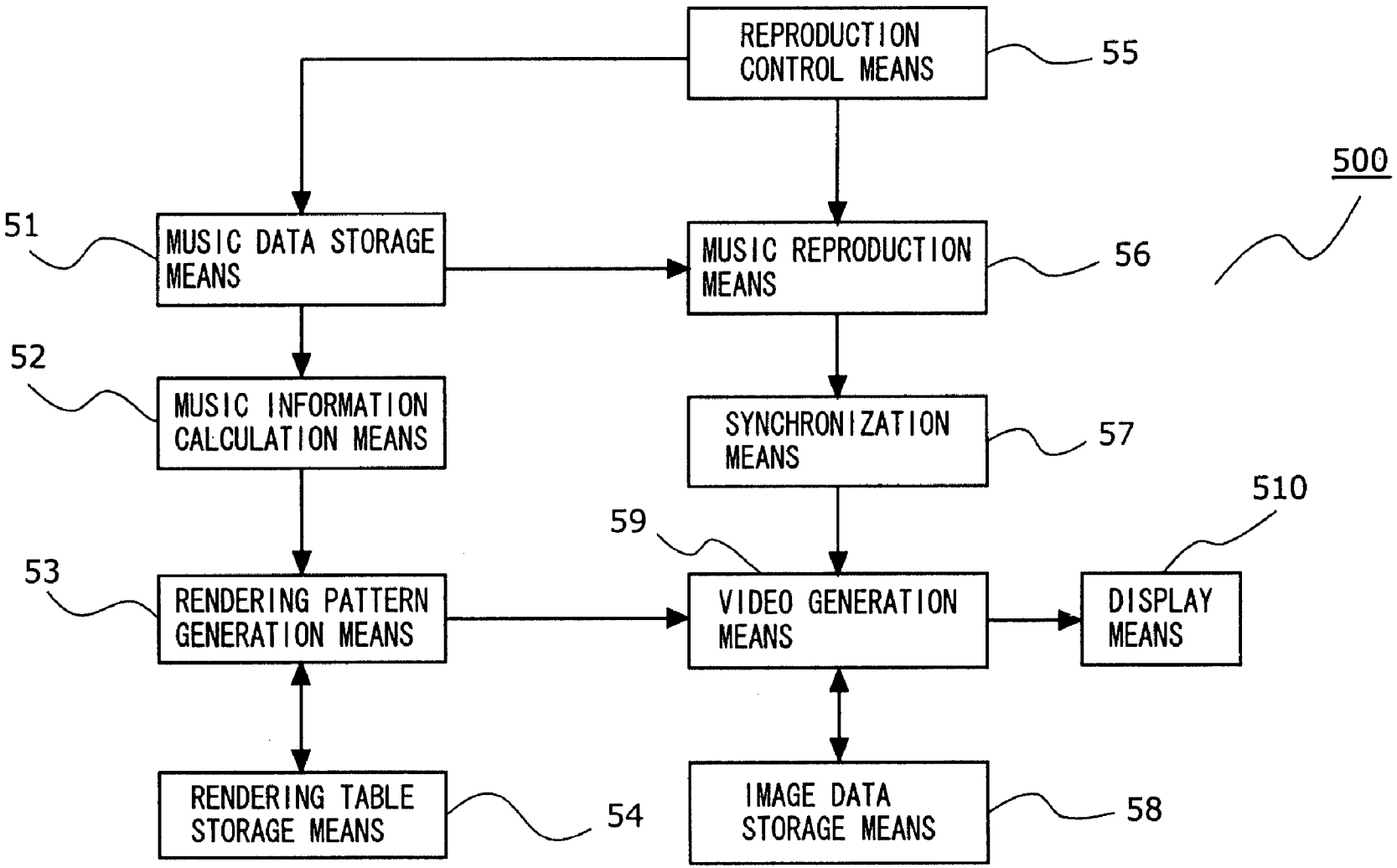
FIG. 6 is a block diagram illustrating a structure of a music reproduction apparatus according to a second embodiment.

FIG. 6 is a schematic diagram illustrating a structure of a music reproduction apparatus 500 according to a second embodiment. As shown in FIG. 6, the music reproduction apparatus 500 comprises: a music data storage means 51; a music information calculation means 52; a rendering pattern generation means 53; a rendering table storage means 54; a reproduction control means 55; a music reproduction means 56; a synchronization means 57; an image data storage means 58; a video generation means 59; and a display means 510. The music reproduction apparatus 500 is an apparatus for displaying an image in synchronization with music being reproduced, and is an apparatus for, for example, switching between images and/or editing an image using the story information acquired in the method according to the first embodiment.

In the present embodiment, each of the music information calculation means 52, the rendering pattern generation means 53, the synchronization means 57, and the video generation means 59 is shown as a separate block. However, these means may not be necessarily separated from each other, and they may be provided on one chip as an integrated circuit such as an LSI or a dedicated signal processing circuit. Alternatively, blocks functioning as these means may be provided as chips, respectively. When the LSI includes a temporary memory, the rendering table storage means 54 may be included in the LSI. The LSI described here is also referred to as an IC, a system LSI, a super LSI, or an ultra LSI, depending on an integration level. Further, the integrated circuit may not be necessarily an LSI, and may be realized as a dedicated circuit or a general-purpose processor. It is possible to use an FPGA (Field Programmable Gate Array) which is programmable after a production of an LSI, or a reconfigurable processor which can reconfigure, after a production of an LSI, a connection between and setting of circuit cells inside the LSI. Further, when an advance in semiconductor technology or another technology derived from the advance leads to an appearance of a circuit-integration technology which can replace the LSI, it goes without saying that an integration of the functional blocks may be performed using the technology.

The music data storage means 51, which corresponds to, for example, a hard disc device and the like, stores an acoustic signal of at least one piece of music. The music data storage means 51 is capable of outputting the acoustic signal of music selected by the reproduction control means 55 to the music information calculation means 52 and the music reproduction means 56.

The acoustic signal outputted by the music data storage means 51 is inputted to the music information calculation means 52. The music information calculation means 52 performs the same process as the aforementioned music information calculation apparatus 1 so as to calculate music story information relating to a music structure. That is, story values, story nodes and inflection degrees are calculated based on the acoustic signal having been inputted. The story information having been generated is outputted to the rendering pattern generation means 53.

The rendering pattern generation means 53 generates a rendering pattern of a video based on the music story information outputted by the music information calculation means 52. Here, the rendering pattern represents information indicating correspondence between a reproduction time and a video effect process to be executed at the reproduction time. The video effect process represents a process of subjecting the video to some change, and includes processes such as a fading-in, a fading-out, and an image rotation. The rendering patterns having been generated are stored as a rendering table in the rendering table storage means 54.

Figure 8:
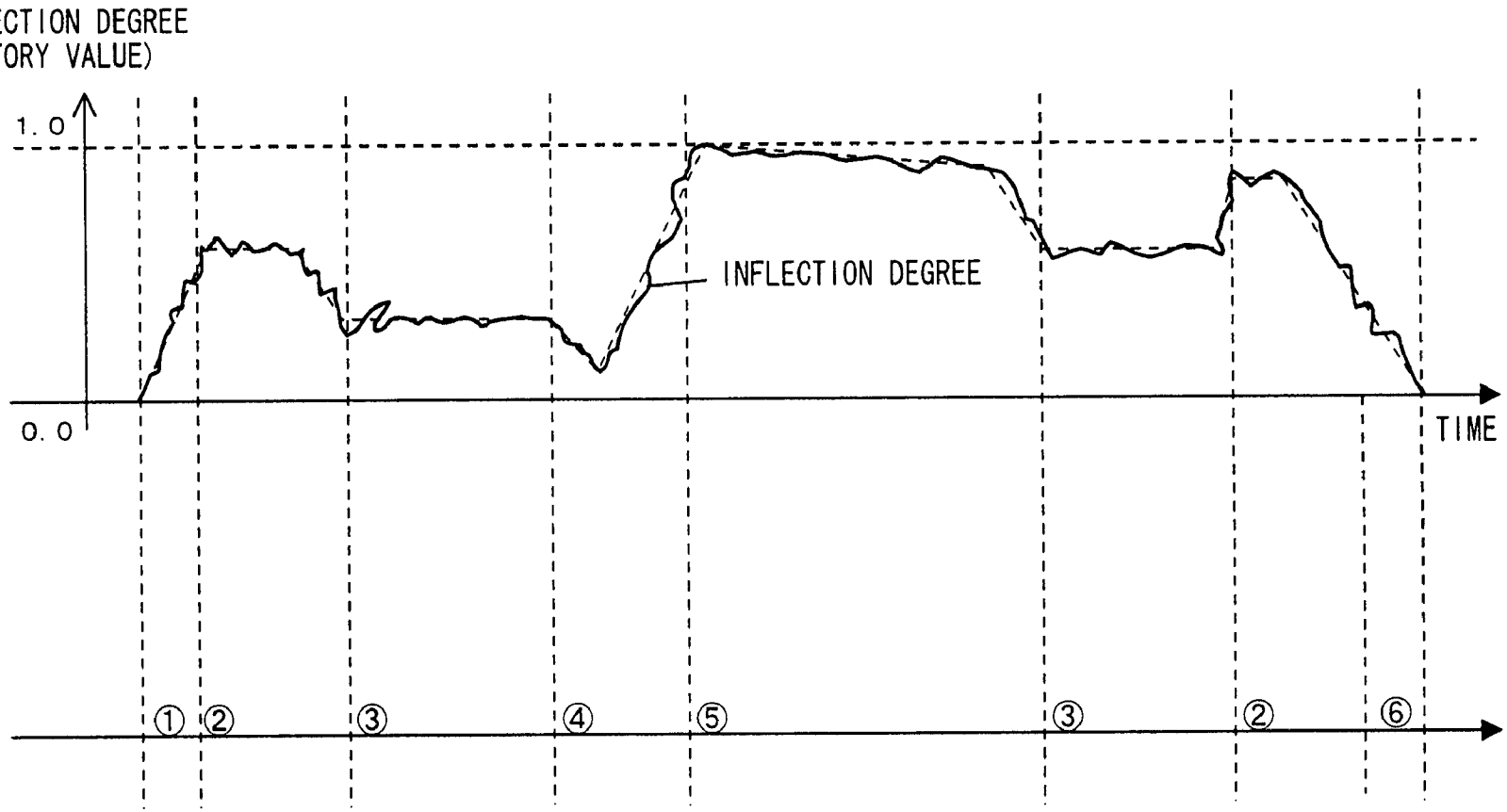
FIG. 8 is a diagram illustrating a relationship between the rendering patterns and a temporal change of music story information in the music reproduction apparatus according to the second embodiment.

FIG. 7 shows an exemplary rendering table containing the rendering patterns having been generated by the rendering pattern generation means 53. The rendering table shown in FIG. 7 indicates a correspondence between a node type and the video effect process to be executed when the story node corresponding to the node type is detected. The node type represents the musical attribute as described in the first embodiment, and each of the node types has a musical formation. FIG. 8 is a diagram illustrating a relationship between the rendering patterns and a temporal change of the story information calculated by the music information calculation means 52. An axis of ordinates represents an inflection degree and an axis of abscissas represents a music reproduction time. Further, as in the first embodiment, the inflection degree at each story node is represented as the story value. In FIG. 8, reference numerals denoted for the respective nodes correspond to the numbers denoted for video effects in the rendering table shown in FIG. 7, respectively. For example, in FIG. 7, in a portion (node denoted by (1) in FIG. 8) in which the node type of music represents the "music start point", the video effect process corresponding to the "facing-in" is performed. That is, at a time corresponding to the story node having the node type of the "music start point", the fading-in is performed, i.e., performed is the video effect process of displaying an image so as to gradually become distinctly visible as time passes. Further, for example, in a portion (node denoted by (4) in FIG. 8) in which the node type represents the "break", performed is the video effect process of displaying a black screen on the display means 510 for 0.5 seconds. Furthermore, in a portion (node denoted by (5) in FIG. 8) in which the node type represents the "climax part start point", the video effect process of rotating an image for one second is performed. Thus, the rendering pattern generation means generates the rendering table used for providing the video effect depending on the music story. The correspondence between the node type and the video effect in the rendering table may be changed by a user. In a portion in which the node type represents the "climax part start", various video effects may be combined so as to, for example, "display a photograph selected by the user".

The reproduction control means 55 instructs for an output of the acoustic signal stored in the music data storage means 51 based on the music selection instruction from a user. Further, the reproduction control means 55 controls the music reproduction means 56 so as to perform a reproduction control such as reproducing music, stopping music and the like.

The music reproduction means 56 outputs, in accordance with the instruction from the reproduction control means 55, the acoustic signal outputted by the music data storage means 51 in a format in which the user can listen to the acoustic signal. For example, the acoustic signal is amplified and outputted by a loudspeaker.

The synchronization means 57 monitors a music reproduction process performed by the music reproduction means 56, and generates and outputs a synchronization signal used for synchronization with the music reproduction process. The synchronization signal generated by the synchronization means 57 is a signal used for synchronizing music with video data generated by the video generation means 59 described below. The synchronization means 57 outputs the synchronization signal having been generated to the video generation means 59.

The image data storage means 58 stores at least one piece of image data. As the image data, still images or moving images are stored. The image data having been stored is outputted in accordance with an instruction from the video generation means 59.

The video generation means 59 sequentially acquires image data stored in the image data storage means 58, and displays a video being subjected to some change for each story node so as to generate video data. Further, the video generation means 59 reproduces the video data in synchronization with the synchronization signal outputted by the synchronization means 57 and outputs the reproduced video data to the display means 510. When the video data is generated, the video generation means 59 performs a process of subjecting, to a predetermined video effect, an image to be displayed at a predetermined reproduction time, based on the rendering table. Thus, the video generation means 59 can automatically perform, based on the rendering table, an edition to be performed by a specialist in video editing.

The display means 510, which corresponds to a display device or the like, displays the video data outputted by the video generation means 59 as a visible image.

Figure 9:
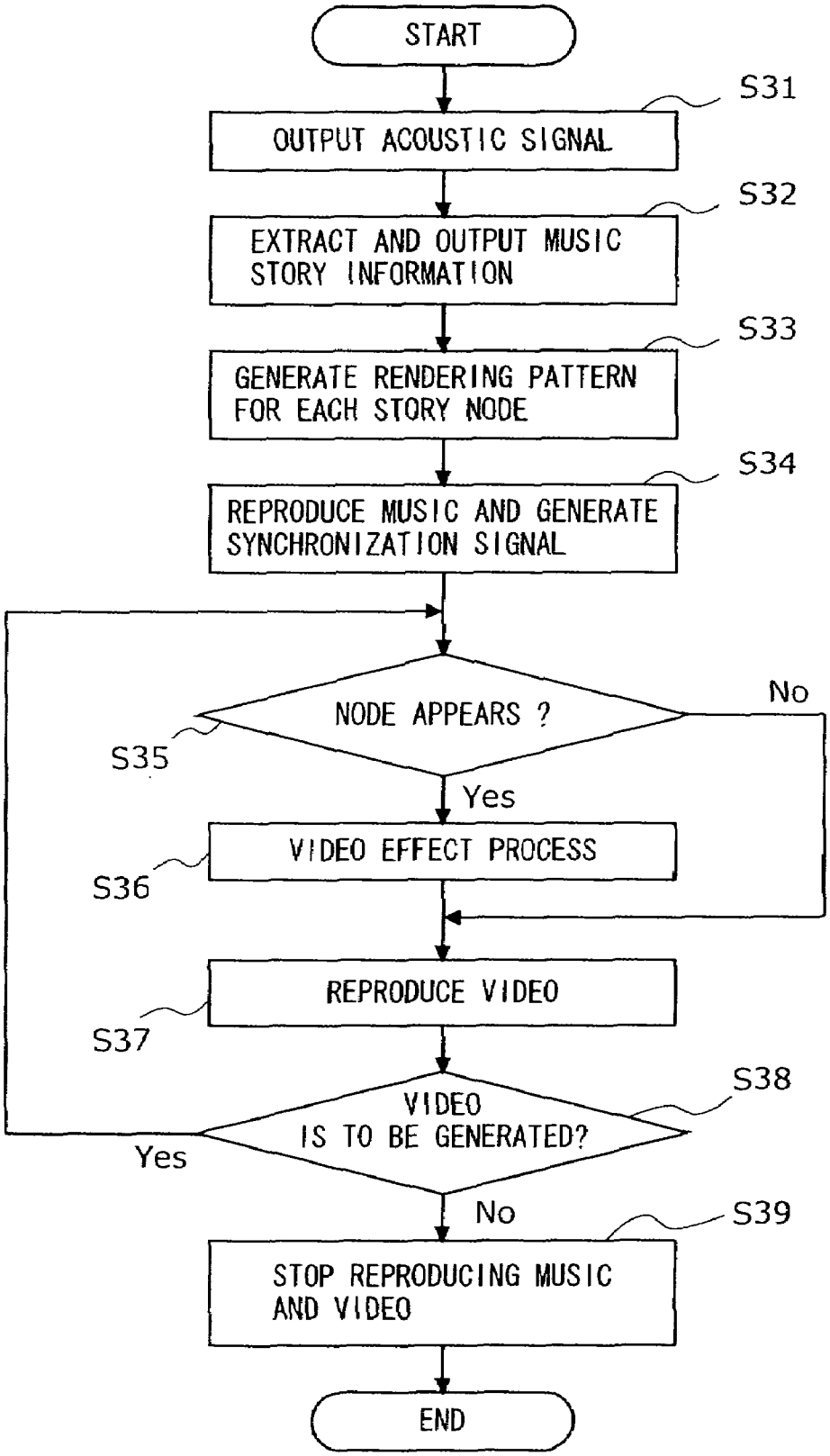
FIG. 9 is a flow chart illustrating a music reproduction process performed by the music reproduction apparatus according to the second embodiment.

Next, a reproduction process performed by the music reproduction apparatus 500 will be described. FIG. 9 is a flow chart illustrating the music reproduction process performed by the music reproduction apparatus 500. The process shown in FIG. 9 starts when a user's instruction for selecting music A is inputted to the reproduction control means 55. Initially, in step S31, the music data storage means 51 outputs an acoustic signal of the music A to the music information calculation means 52 in accordance with the instruction from the reproduction control means 55.

Next, in the process of step S32, the music information calculation means 52 calculates music information relating to the music A in the process shown in FIG. 3. Thus, the story nodes, the inflection degrees (story values), and the node types relating to the music A are outputted.

Subsequently, in the process of step S33, the rendering pattern generation means 53 generates the rendering patterns. The rendering pattern generation means 53 determines the video effect processes corresponding to the story nodes having been acquired in step S32, based on the correspondences between the video effects and the node types contained in the rendering table which is previously stored in the rendering table storage means 54. The rendering patterns having been determined are outputted to the video generation means 59.

Next, in step S34, the music reproduction means 56 starts to reproduce the music A in accordance with the instruction from the reproduction control means 55. Further, the synchronization means outputs the synchronization signal to the video generation means 59 in synchronization with the music A being reproduced.

In the process of step S35, the video generation means 59 determines whether or not the story node appears, based on the rendering pattern generated by the rendering pattern generation means 53. When the story node appears, the video generation means 59 generates, in step S36, video data by subjecting an image to the video effect process in accordance with the rendering pattern. On the other hand, when the story node does not appear, the video generation means 59 generates video data without subjecting the image to the video effect process, and advances the process to step S37. The video data generated in the process of step S37 is reproduced in accordance with the synchronization signal and displayed on the display means 510.

Next, in the process of step S38, the video generation means 59 determines, based on the rendering pattern, whether or not the generation of the video data is to be performed. When the video data is to be generated, the video generation means 59 returns the process to step S35 and determines whether or not the subsequent story node appears, and thereafter performs the same processes as step S36 and the subsequent steps. On the other hand, when the rendering pattern instructs no generation of a video, the process advances to step S39.

In step S39, the music reproduction means 56 stops reproducing the music A in response to the instruction, from the reproduction control means 55, for stopping the reproduction. Simultaneously, the video generation means 59 stops reproducing the video data when receiving the synchronization signal for stopping the reproduction. This is the end of the reproduction process performed by the music reproduction apparatus 500.

As described above, the music reproduction apparatus according to the present embodiment can recognize the music structure based on the magnitude of feature of the acoustic signal, and therefore the video can be easily rendered based on a change of a tune or a music dramatic part. Further, the video can be rendered based on the musical attribute with no need for a user to listen to the music, and therefore the music reproduction apparatus having an improved user-friendliness can be realized. Further, the music reproduction apparatus according to the present embodiment generates the video in synchronization with the music being reproduced, and therefore the music and the video can be reproduced with a visual and auditory effect.

Although in the present embodiment the rendering pattern is determined for each node type, the present invention is not restricted thereto. In FIG. 9, the rendering pattern may be determined in accordance with a magnitude of the story value. For example, in a region in which the inflection degree is great, the video data may be generated so as to shorten an image change cycle, and in a region in which the inflection degree is small, the video data may be generated so as to extend an image change cycle. Further, for example, the rendering may be performed such that when the story value is great, an image having a bright color tone may be selected, and when the story value is small, an image having a dark color tone may be selected.

Although the music information calculation apparatus and the music information calculation means of the first and the second embodiments are used for the music reproduction apparatus for displaying a video in synchronization with music, the present invention is not restricted thereto. For example, in a region between the "break start point" and the "break end point" which are represented as the node types of the music, a rendering process may be performed in combination with a process performed by another apparatus so as to, for example darken a room lighting.

Although in the music information calculation apparatus and the music information calculation means of the first and the second embodiments the short time power average value and the zero cross value are used as the acoustic parameters, the present invention is not restricted thereto. For example, a chroma vector is used as the acoustic parameter such that the evaluation function calculation means may calculate the evaluation function for obtaining a similarity in a scale structure of music. Thus, by detecting a boundary between the repeated portions in the scale structure, the music structure can be also recognized in a chapter. That is, the story node, in the chapter portion, representing a boundary between, for example, an A melody and a B melody can be calculated. Thus, the music information calculation apparatus can more specifically recognize the music structure.

Further, for example, an MFCC (Mel Frequency Cepstrum Coefficient) can be used as the acoustic parameter. Thus, an amplitude envelope characteristic and a tone characteristic of the acoustic signal can be acquired. The evaluation function calculation means calculates the evaluation function representing a significant tone change of music by using the MFCC. Therefore, the music information calculation apparatus can detect for the story node representing the boundary of the tone change, that is, the story nodes representing a start and an end portions of the tutti.

Although the music information calculation apparatus and the music information calculation means of the first and the second embodiments use the zero cross value as the acoustic parameter, the present invention is not restricted thereto. The zero cross value can be replaced with, for example, a spectrum centroid.

Although in the first and the second embodiments a product of the short time power average value and the zero cross value is used as the inflection degree according to equation 1, the present invention is not restricted thereto. For example, only the short time power average value may be used according to equation 3.

$$tlv(t)=rms(t) \quad \text{(equation 3)}$$

Thus, the calculation amount can be reduced as compared to a case where equation 1 is used.

In the first and the second embodiments, the evaluation function calculation means may subject the acoustic signal having been inputted to frequency-domain conversion so as to calculate the evaluation function based on a distribution of the signals obtained through the conversion.

The music information calculation apparatus and the music information calculation means of the first and the second embodiments may be realized as hardware devices which are incorporated into or connected to a computer. Further, the computer may execute a portion of the process using software.

The music information calculation apparatus and the music reproduction apparatus of the present invention are suitable for a music reproduction apparatus and video reproduction apparatus which are required to render a video based on a feature of music.

The invention claimed is:

1. A music information calculation apparatus comprising:

an acoustic parameter calculation means for calculating, using the acoustic signal from an acoustic signal input means, a first acoustic parameter indicating a volume of the piece of music and a second acoustic parameter indicating a tone of the piece of music;

an inflection degree calculation means for calculating, using the first acoustic parameter and the second acoustic parameter, an inflection degree indicating an inflection of the piece of music;

a story node calculation means for calculating, using the first acoustic parameter, a story node representing a time at which a formation of the piece of music changes; and a story information calculation means for calculating, as story information indicating the formation of the piece of music, information representing a correspondence between the calculated story node and the calculated inflection degree obtained at the time represented by the calculated story node, wherein the first acoustic parameter indicates a short time power average value of the acoustic signal, wherein the second acoustic parameter indicates a zero cross value of the acoustic signal, and wherein the inflection degree calculation means calculates the inflection degree, using a product of the short time power average value and the zero cross value of the acoustic signal.

2. A music reproduction apparatus for reproducing a video synchronized to a piece of music, the music reproduction apparatus comprising:

an acoustic signal storage means for storing an acoustic signal of the piece of music;

an image data storage means for storing image data;

an acoustic parameter calculation means for calculating, using the acoustic signal from the acoustic signal storage means, a first acoustic parameter indicating a volume of the piece of music and a second acoustic parameter indicating a tone of the piece of music;

an inflection degree calculation means for calculating, using the first acoustic parameter and the second acoustic parameter, an inflection degree indicating an inflection of the piece of music;

a story node calculation means for calculating, using the first acoustic parameter, a story node representing a time at which a formation of the piece of music changes;

a story information calculation means for calculating, as story information indicating the formation of the piece of music, information representing a correspondence between the calculated story node and the calculated inflection degree obtained at the time represented by the calculated story node;

a music reproduction means for reproducing the acoustic signal of the piece of music;

a video generation means for generating the video using the image data from the image data storage means; and a display means for displaying the video generated by the video generation means in synchronization with the piece of music being reproduced by the music reproduction means, wherein the video generation means (i) generates the video such that a content of the video is subjected to a predetermined change at a time represented by the calculated story node represented in the story information, and (ii) determines a type of the predetermined change using the calculated inflection degree obtained at the time represented by the calculated story node, wherein the first acoustic parameter indicates a short time power average value of the acoustic signal, wherein the second acoustic parameter indicates a zero cross value of the acoustic signal, and wherein the inflection degree calculation means calculates the inflection degree, using a product of the short time power average value and the zero cross value of the acoustic signal.

3. The music reproduction apparatus according to claim 2, further comprising a rendering table storage means for storing a rendering table representing a correspondence between (i) a type of the story node of the piece of music and (ii) the type of the predetermined change to which the video is to be subjected at the time represented by the story node of the type, wherein the story information calculation means determines the type of the story node using the inflection degree obtained at the time represented by the story node, and calculates, as the story information, information representing a correspondence between the story node, the inflection degree obtained at the time represented by the story node, and the type of the story node, and wherein the video generation means generates the video such that the content of the video is subjected to the predetermined change at the time represented by the story node represented in the story information, and determines the type of the predetermined change using the type of the story node.

4. The music reproduction apparatus according to claim 3, wherein the rendering table storage means stores the rendering table containing a correspondence between a fading-out process and the story node representing a music end, and wherein the video generation means starts to subject the video to the fading-out process at a point which precedes, by a predetermined time, an end point of the story node having the type of the story node determined as the music end.

5. The music reproduction apparatus according to claim 2, wherein a process of the video generation means subjecting the content of the video to the predetermined change is one process selected from a group consisting of a fading-in process, a fading-out process, an image change process, and an image rotation process.

6. A music information calculation method comprising:

inputting an acoustic signal of a piece of music;

calculating, using the acoustic signal, a first acoustic parameter indicating a volume of the piece of music and a second acoustic parameter indicating a tone of the piece of music;

calculating, using the first acoustic parameter and the second acoustic parameter, an inflection degree indicating an inflection of the piece of music;

calculating, using the first acoustic parameter, a story node representing a time at which a formation of the piece of music changes; and calculating, as story information indicating the formation of the piece of music, information representing a correspondence between the calculated story node and the calculated inflection degree obtained at the time represented by the calculated story node, wherein the first acoustic parameter indicates a short time power average value of the acoustic signal, wherein the second acoustic parameter indicates a zero cross value of the acoustic signal, and wherein the calculation of the inflection degree calculates the inflection degree, using a product of the short time power average value and the zero cross value of the acoustic signal.

7. A music information calculation circuit comprising:

an acoustic signal input means for inputting an acoustic signal of a piece of music;

an acoustic parameter calculation means for calculating, using the acoustic signal from the acoustic signal input means, a first acoustic parameter indicating a volume of the piece of music and a second acoustic parameter indicating a tone of the piece of music;

an inflection degree calculation means for calculating, using the first acoustic parameter and the second acoustic parameter, an inflection degree indicating an inflection of the piece of music;

a story node calculation means for calculating, using the first acoustic parameter, a story node representing a time at which a formation of the piece of music changes; and a story information calculation means for calculating, as story information indicating the formation of the piece of music, information representing a correspondence between the calculated story node and the calculated inflection degree obtained at the time represented by the calculated story node, wherein the first acoustic parameter indicates a short time power average value of the acoustic signal, wherein the second acoustic parameter indicates a zero cross value of the acoustic signal, and wherein the inflection degree calculation means calculates the inflection degree, using a product of the short time power average value and the zero cross value of the acoustic signal.

8. A computer-readable recording medium having a program recorded thereon, the program causing a computer of a music information calculation apparatus for calculating story information indicating a formation of a piece of music to execute a method comprising:

inputting an acoustic signal of a piece of music;

calculating, using the acoustic signal, a first acoustic parameter indicating a volume of the piece of music and a second acoustic parameter indicating a tone of the piece of music;

calculating, using the first acoustic parameter and the second acoustic parameter, an inflection degree indicating an inflection of the piece of music;

calculating, using the first acoustic parameter, a story node representing a time at which a formation of the piece of music changes; and calculating, as story information indicating the formation of the piece of music, information representing a correspondence between the calculated story node and the calculated inflection degree obtained at the time represented by the calculated story node, wherein the first acoustic parameter indicates a short time power average value of the acoustic signal, wherein the second acoustic parameter indicates a zero cross value of the acoustic signal, and wherein the calculation of the inflection degree calculates the inflection degree, using a product of the short time power average value and the zero cross value of the acoustic signal.

* * * * *